US005205109A

United States Patent [19]

Conway

[11] Patent Number: 5,205,109

[45] Date of Patent: Apr. 27, 1993

[54] METHOD AND APPARATUS FOR EXPANDING A BALLOON AND ACCESSING THE INTERIOR THEREOF

[76] Inventor: Matthew J. Conway, 1305 North Hills Blvd., #104, North Little Rock, Ark. 72116

[21] Appl. No.: 816,344

[22] Filed: Dec. 23, 1991

[51] Int. Cl.[5] ..... B65B 43/36; B65B 67/04

[52] U.S. Cl. ..... 53/403; 53/410; 53/459; 53/570; 53/386.1; 53/390

[58] Field of Search ..... 53/390, 385.1, 386.1, 53/384.1, 403, 88, 86, 410, 570; 141/10

[56] References Cited

U.S. PATENT DOCUMENTS

| | | | |
|---|---|---|---|
| 4,809,484 | 3/1989 | Lovik | 53/385.1 X |
| 4,878,335 | 11/1989 | Hardy | 53/390 X |
| 4,924,919 | 5/1990 | Oyler | 141/10 |
| 4,974,393 | 12/1990 | Rich et al. | 53/386.1 X |
| 5,016,428 | 5/1991 | Helling et al. | 53/403 |
| 5,033,256 | 7/1991 | Rupp | 53/385.1 X |
| 5,035,104 | 7/1991 | Helling et al. | 53/386.1 X |
| 5,088,267 | 2/1992 | Gee | 53/386.1 X |

*Primary Examiner*—Horace M. Culver

*Attorney, Agent, or Firm*—Polster, Lieder, Woodruff & Lucchesi

[57] ABSTRACT

An apparatus and method for expanding a balloon in a manner which allows access to the interior of the balloon for the purpose of introducing articles such as toys and permitting decoration of the interior of the balloon. The invention uses a vacuum chamber to expand the balloon and a novel holding means for securing the mouth of the balloon exterior of the chamber so that the neck of the balloon may be knotted and sealed prior to the balloon being removed from the vacuum chamber.

6 Claims, 2 Drawing Sheets

METHOD AND APPARATUS FOR EXPANDING A BALLOON AND ACCESSING THE INTERIOR THEREOF

BACKGROUND OF THE INVENTION

The present invention relates to a method and apparatus for expanding a balloon in such a manner as to allow access to the interior of the balloon and to permit the introduction of articles into the balloon prior to the balloon being sealed. While the apparatus is described as an individual unit, the invention may be employed in kit form for retro fitting to existing expanding devices.

Stuffed animals and other toys have been presented as gifts inside inflated balloons since antiquity appeared. All the methods and devices essentially employ a way to expand the mouth of the balloon, a way to expand the balloon itself, and a way to seal the balloon after placement of an article within in. A particular method of introducing articles into an inflated balloon is disclosed in U.S. Pat. No. 4,924,919. According to the method employed in that patent, the mouth of a balloon is secured to a tube which extends into a chamber. The chamber is then evacuated by the air pump causing air exterior of the chamber to enter through the tube and inflate the balloon. Articles can then be inserted through the tube and into the expanded balloon. Thereafter, the tube is closed off and ambient air pressure is restored to the chamber. The balloon, still attached to the tube is then removed from the chamber, and the mouth of the balloon is then tied off. Thereafter, the balloon is removed from the tube. While the method and apparatus disclosed in the U.S. Pat. No. 4,924,919 works for its intended purpose, the use of this in a similar devices in the prior art is time consuming and difficult. The apparatus requires the tube, a closure for the evacuation attached to the evacuation chamber in a plug or closure for the tube itself. Because the balloon mouth is within the evacuation chamber, the tube leading to the balloon must be closed prior to removal of the balloon. The balloon itself can not be sealed, as by tying, until the entire balloon is and associated structure is removed from the evacuation chamber.

SUMMARY OF THE INVENTION

It is an object of the invention to provide an improved method of expanding a balloon and accessing the interior thereof for placing articles in the balloon and for decorating the interior of the balloon.

It is another object of the invention to provide an improved apparatus for inflating balloons and providing access to the interior of the balloons for the purpose of introducing articles therein and/or decorating the interior thereof.

It is a still further object of the invention to provide an improved lid or cover in kit form for existing balloon machines which can be substituted for the multiple parts of existing machines to enable such machines to perform the improved method of the present invention.

Generally, the invention provides for a method and apparatus for expanding a balloon and providing access to the interior of the balloon comprising a chamber having a vacuum pump opening on the bottom thereof and a balloon inflation opening through a cover on top thereof. The balloon inflation opening is defined by an attachment member having a diameter large enough to provide access through the cover. The attachment member extends outwardly from the chamber cover. A balloon holding means, such as a lip, defined by the exterior of the attachment member is positioned outside of the chamber. The balloon holder means permits a user to secure the neck of a balloon to the device, causing the balloon to seal the attachment member opening. The air in the chamber is then evacuated through the vacuum pump opening and air outside the chamber is pulled into the chamber through the balloon neck causing the balloon to inflate within the chamber. Articles and/or decorations may then be introduced into the expanded balloon through the balloon neck.

An important provision of the invention is that after sufficient expansion, the balloon itself will provide an annular seal inside the chamber between the cover and the inside of the chamber. Thus, the neck of the balloon can be released from the exterior holding means before the neck is closed either by a string or by tying the neck in a knot. The present invention also discloses means for removing the neck of the balloon from the holding means in a facile manner. Further, after the neck of the balloon is closed, a simple dimpling of the balloon by a finger stuck through the tube will break the annular seal formed by the balloon causing air to rush into the chamber and allowing the balloon itself to pop the improved lid off of the chamber.

These as well as other objects and advantages will become more apparent upon a reading of the description of a preferred embodiment in conjunction with drawings wherein:

DETAILED DESCRIPTION OF THE PREFERRED EMBODIMENT

Figure 1:
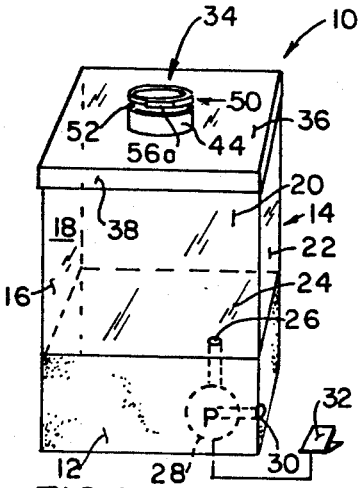
FIG. 1 is a perspective view of a balloon expanding machine according to the principles of the present invention with the vacuum pump and actuator switch therefor shown diagrammatically.
Figure 2:
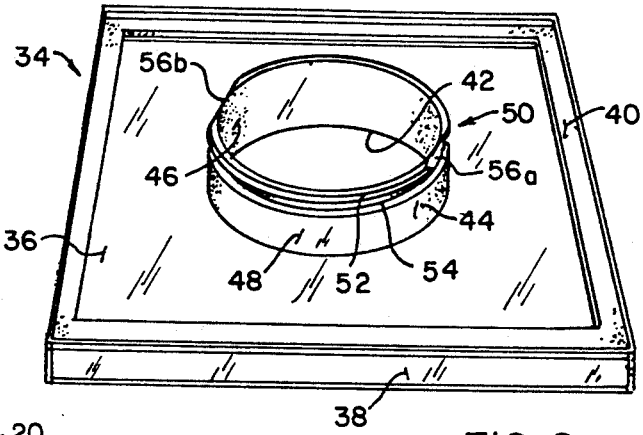
FIG. 2 is an enlarged perspective view of the novel balloon machine cover or lid per se.

With reference to the drawings, and FIG. 1 in particular, there is shown one illustrative embodiment of balloon machine constructed according to the principles of the present invention and generally referred to by the reference character 10.

Machine 10 includes a base 12 and a vacuum chamber 14 carried by base 12. Vacuum chamber 14 is preferably cubical or rectangular in shape and defined in the preferred embodiment, by upstanding clear glass or plastic walls 16, 18, 20, 22 sealed to one another and to horizontal base wall 24. Base wall 24 includes an opening 26 located preferably in a corner area of base wall 24 so that an inflated balloon will not interfere with opening 26. Positioned within base 12 is a vacuum air pump 28 which is in fluid communication with opening 26 and is adapted to evacuate or pump air from chamber 14 through opening 26 and exhaust the air through exhaust opening 30. Pump 28 is electrically powered and preferably switched on and off by actuation of a foot pedal switch 32.

The upper edges of side walls 16, 18, 20, 22 define an access opening in vacuum chamber 14 which may be closed by removable top lid 34. Lid 34 includes a generally planar square or rectangular cover 36 constructed of clear plastic and sized to fit over the top edges of upstanding walls 16, 18, 20, 22. Depending from cover 36 on all four sides is a short plastic skirt 38 to insure proper placement of cover 36 over upstanding walls 16, 18, 20, 22. On the underside surface of cover 36 along the edges thereof there is positioned a seal 40 of foam rubber or plastic which will rest upon and seal the top edges of upstanding walls 16, 18, 20, 24 with cover 36.

Figure 7:
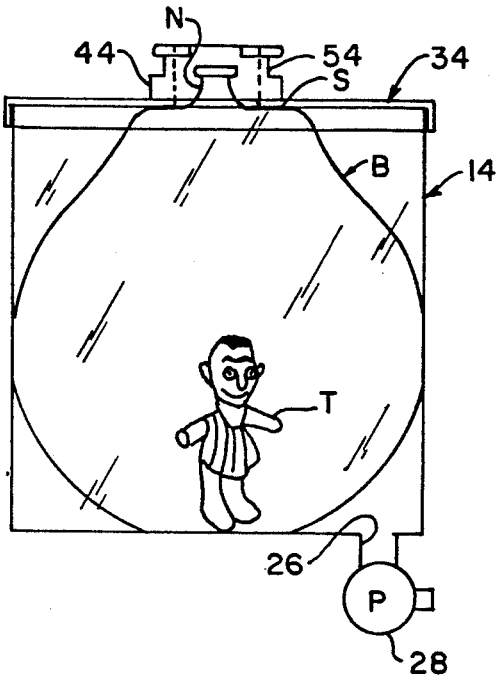
FIG. 7 is a view similar to FIG. 3 showing the neck of the balloon disconnected from the tube ready for sealing.

Cover 36 is provided with a central opening 42. A generally cylindrical attachment member 44 for an inside surface 46 defining opening 42. Member 44 extends upwardly and outwardly of vacuum chamber 14, leaving the inside surface of cover 36 proximate opening 42 planar and free of protrusions. On the exterior surface 48 of member 44 there is provided balloon mouth and neck holding means 50 comprised of an annular, radially outwardly extending lip 52 formed around a major portion of the free end of member 44. Lip 52 may extend radially outwardly from the outside dimension of member 44, or lip 52 may help to define with the outside dimension of member 44 an annular groove 54 as best seen in FIG. 7. Lip 52 is interrupted preferably by two diametrically opposed flats **56*a*, 56*b* which provide a smooth passage from one longitudinal side of lip 52 to the other longitudinal side thereof. The inside diameter of member 44** is sufficient to allow access through the tube for articles or decorating procedures as will be explained herein below.

Figure 3:
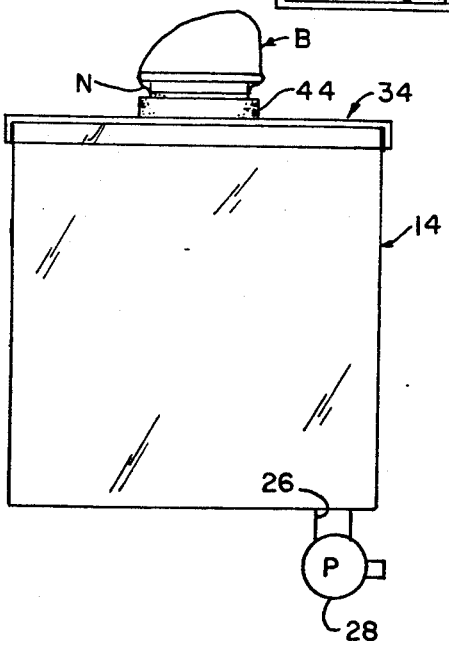
FIG. 3 is a diagram of a side view of the balloon machine chamber showing the balloon prior to chamber evacuation.

The novel operational method will now be detailed with reference to FIGS. 3–9. As seen in FIG. 3 a conventional, preferably eighteen inch, wide mouth latex balloon B having an open mouth connected to the body of the balloon by neck N is fitted over member 44. This is accomplished by stretching the neck of the balloon open and fitting a portion of the neck beneath lip 52 into groove 54. This procedure should be started at a point beneath lip 52 about ninety degrees from flats **56*a*, 56*b*. The neck N of balloon B is then stretched laterally and back from the starting point until the entire mouth of the balloon is over member 44 and is contracted and held in place within groove 54 as shown in FIG. 3. It can readily be seen that balloon B will act to seal the end of member 44 preventing the passage of air through member 44 and into chamber 14**.

Figure 4:
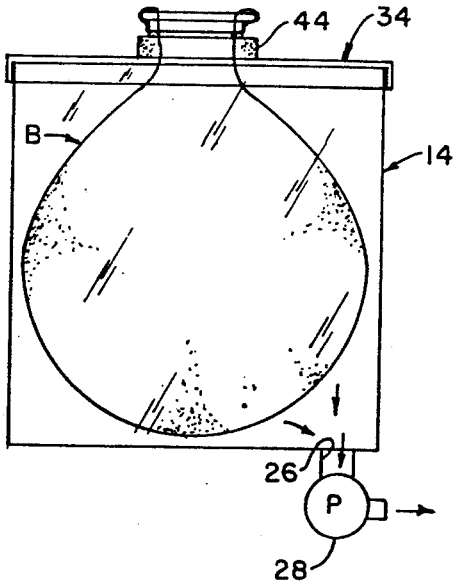
FIG. 4 is a view similar to FIG. 3 showing the balloon being expanded within, the chamber.

As depicted in FIG. 4, foot switch 32 (FIG. 1) is depressed actuating vacuum pump 28 which acts to evacuate air in chamber 14. This action will cause lid 34 to be pulled harder against the top edges of side walls 16, 18, 20, 22 and thus create an even greater seal between these walls and seal 40 of lid 34. At the same time, balloon B will be drawn into chamber 14 and will be expanded by the force of the air drawn into the balloon by the pressure differential created by pump 28.

Figure 5:
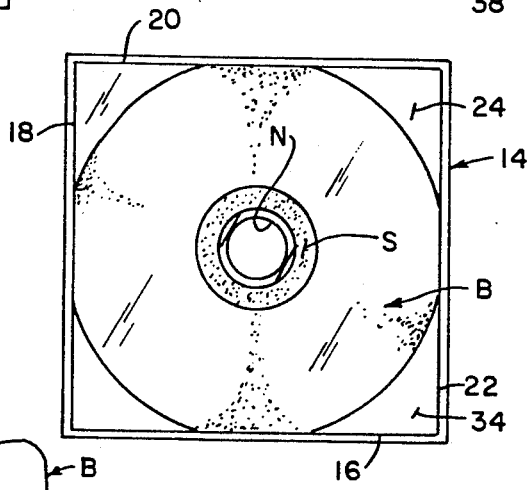
FIG. 5 is a top plan view showing the annular seal created by the balloon against the inside surface of the lid.
Figure 6:
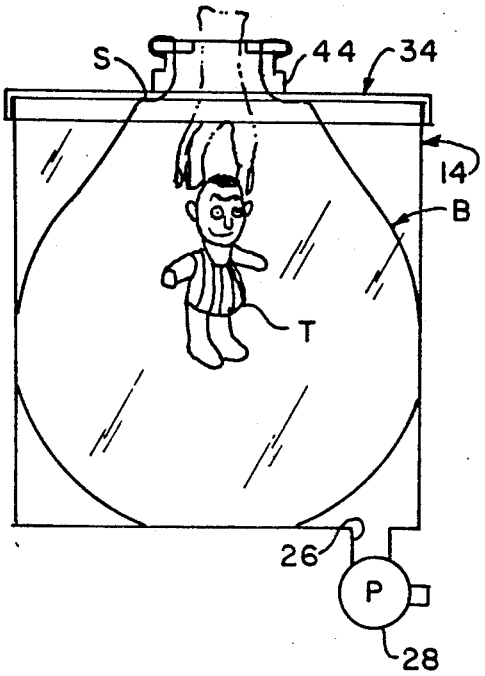
FIG. 6 is a view similar to FIG. 3 showing the introduction of an article into the expanded balloon.

FIGS. 5 and 6 show balloon B in its fully expanded position according to the inventive method. When fully expanded within chamber 14, the lower and upper surface areas of balloon B are forced, by the pressure of the air within the balloon, against bottom wall 24 and the inside bottom surface of cover member 36, respectively. As seen in FIG. 5, when the upper surface area of balloon B is forced up against the smooth inside surface of cover member 36, an annular seal S is created around opening 42. Since cover member 36 is clear it can readily be seen when a sufficient seal S of about one-half inch thickness is created. At this point switch 32 is released and further expansion of balloon B halted. It is noted that the sides of balloon B may or may not be in contact with side walls 16, 18, 20, 22 or bottom wall 24.

At this point in time, balloon B may be accessed through the expanded mouth and neck thereof. Articles such as one or more toys T or other gifts or decorations may be inserted into balloon B. Also it is contemplated that paper streamers and cut-outs may be glued to the inside surface of the balloon to create a festive party favor. Signs or other indicia may also be placed inside the balloon. The size of opening 42 and ones own imagination are the only limitations in creating a decorative balloon.

After access to the interior of balloon B is completed, the balloon is checked to make sure seal S has not been destroyed by leakage of air into chamber 14. If seal S is insufficient, pump 28 is again activated for a short time to withdraw air from chamber 14 and thus cause balloon B to expand and reestablish seal S. When visual inspection assures the presence of seal S, neck N of balloon B is removed from holding means 50 by pulling up on the edges of the mouth at the locations of flats **56*a*, 56*b*. Once a portion of the mouth is pulled above lip 52 it may be stretched from one side to the other to completely release neck N from around lip 52**.

Figure 8:
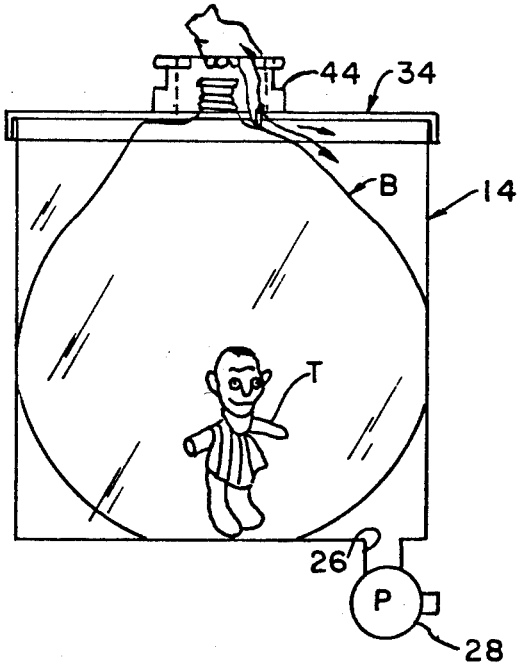
FIG. 8 is a view similar to FIG. 3 showing the neck of the balloon being closed and the annular seal formed by the balloon being broken.
Figure 9:
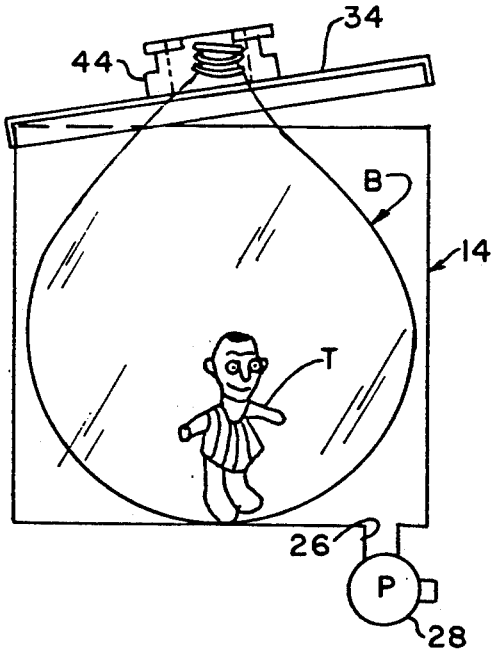
FIG. 9 is a view similar to FIG. 3 showing the balloon taking its normal shape in the ambient atmospheric pressure and causing the lid to pop up off the chamber walls.

As shown in FIG. 7, due to the presence of seal S, neck N of balloon B may be released unsealed. Balloon B will not deflate due to the pressure differential existing on opposite sides of the balloon skin. The neck N of balloon B may then either be sealed with string, ribbon or the like, or preferably neck N is tied in a knot to seal the interior of the balloon from the external environment. At this time, as shown in FIG. 8, a finger may be inserted through tube 44 to dimple the balloon and break seal S causing ambient air to enter vacuum chamber 14 through tube 44. Lid 34 will no longer be pulled down by a pressure differential and the pressure differential between the inside and outside of the balloon will decrease causing the balloon to spring into a more normal inflated configuration wherein it will push up on and raise lid 34 as shown in FIG. 9. The decorated balloon may now be easily removed from chamber 14.

It can thus be seen that the apparatus and method described hereinabove fulfills the objects and provide the advantages set forth above. Numerous modifications may be made to the preferred embodiment without departing from the spirit and scope of the invention. For example, after accessing the interior of a balloon with a soft toy, the balloon may be deflated for shipment to a retailer who may inflate the balloon by means of a conventional pressure hose; or different balloon neck and mouth holding means may be employed outside of the vacuum chamber. The design silhouette of the apparatus may be varied. For example, the chamber may be constructed in a circular configuration, if desired. While certain materials were described as preferred, other material may be used in other embodiments of the invention. These variations are merely illustrative. Thus the scope of the invention is to be determined solely by the language of the following claims.

What is claimed is:

1. An apparatus for expanding a balloon and for providing access to the interior of the balloon comprising:

a chamber having a first opening and a second opening;

means for evacuating air from said chamber through said first opening;

said second opening being defined at least in part by a member extending outwardly from said chamber;

means on said member outside said chamber for holding the neck of a balloon on said member such that when said chamber is evacuated, the balloon will be expanded within said chamber by air entering the balloon through the neck of the balloon;

said means for holding the neck of a balloon include a lip extending around at least a portion of the exterior of said member over which the neck of the balloon will contract; and a pair of diametrically opposed flats are formed in said lip to aid in removing the neck of the balloon from said lip.

2. An improved lid for a balloon expanding machine, the machine having a chamber which may be evacuated, and an access opening to the chamber to be covered, said lid comprising:

a cover adapted to cover and seal the access opening to such chamber;

a balloon inflation opening through said cover;

a member defining said inflation opening and extending in a direction outward of such chamber;

means on the exterior of said member and outside said chamber for holding the neck of a balloon around the exterior of said member;

said means for holding the neck of a balloon include a lip extending around at least a major portion of the exterior of said member over which the neck of the balloon will contract; and a pair of diametrically opposed flats are formed in said lip to aid in removing the neck of the balloon from said lip.

3. A method of inflating and accessing the interior of a balloon comprising the steps of:

stretching and holding the neck of a balloon around the exterior of a member having a sufficiently large opening therethrough to permit access to the interior of the balloon;

evacuating air from a chamber in communication with the member to draw the balloon into the chamber through the member and to inflate the balloon within the chamber such that the balloon creates a seal with an inner surface of the chamber around said member;

accessing the interior of the balloon through the neck of the balloon;

freeing the neck of the balloon from around the exterior and the member while maintaining said seal;

subsequent to said freeing, closing the mouth of the balloon; and subsequent to said freeing and closing, breaking said seal and allowing air to enter said chamber.

4. The method as specified in claim 3 wherein:

said freeing the neck of the balloon includes pulling diametrically opposed portions of the neck toward the free end of the member and away from the chamber along a pair of diametrically opposed flats on the exterior of the member formed through the lip.

5. A method of inflating and decorating the interior of a balloon comprising the steps of: p1 stretching and holding the neck of a balloon around the exterior of a member having a sufficiently large opening therethrough to permit a desired decorating action;

evacuating air from a chamber in communication with the member to inflate the balloon within the chamber such that the balloon creates a seal with an inner surface of the chamber around said member;

decorating the interior of the balloon through the neck of the balloon;

freeing the neck of the balloon from around the exterior and the member while maintaining said seal;

closing the neck of the balloon such that the balloon is in its inflated usable condition; and subsequent to said closing, breaking said seal to allow air to enter said chamber, and removing the balloon from the chamber.

6. The method as specified in claim 5 wherein:

said freeing the neck of the balloon includes pulling diametrically opposed portions of the neck toward the free end of the member and away from the chamber along a pair of diametrically opposed flats on the exterior of the tube formed through the lip.

* * * * *

UNITED STATES PATENT AND TRADEMARK OFFICE

CERTIFICATE OF CORRECTION

PATENT NO. : 5,205,109

DATED : Apr. 27, 1993

INVENTOR(S) : Matthew J. Conway

It is certified that error appears in the above-indentified patent and that said Letters Patent is hereby corrected as shown below:

In the claims:

Claim 5, Column 6, line 27, note "p1" should be deleted and a new paragraph should begin with the word -- stretching Claim 6, Column 6, line 48, "member" should be --tube --

Signed and Sealed this

Sixteenth Day of August, 1994

Bruce Lehman

*Attest:*

BRUCE LEHMAN

*Attesting Officer*

*Commissioner of Patents and Trademarks*